United States Patent [19]

Ritzl

[11] 4,341,163

[45] Jul. 27, 1982

[54] VEHICLE SUPERSTRUCTURE IN PARTICULAR FOR RAILWAY VEHICLES WITH HOODS WHICH CAN BE EXPANDED OUTWARDS AND MOVED WITH RESPECT TO THE LOAD BEARING PLATFORM

[75] Inventor: Antal Ritzl, Bergdietikon, Switzerland

[73] Assignee: Swiss Aluminium Ltd., Chippis, Switzerland

[21] Appl. No.: 117,486

[22] Filed: Feb. 1, 1980

[51] Int. Cl.[3] ..... B61D 39/00

[52] U.S. Cl. ..... 105/377; 52/55; 49/136

[58] Field of Search ..... 105/377; 52/45, 46, 52/47, 48, 49, 50, 51, 55; 49/136

[56] References Cited

U.S. PATENT DOCUMENTS

| | | | |
|---|---|---|---|
| 2,201,737 | 5/1940 | Meyer et al. | 105/377 |
| 3,520,257 | 7/1970 | James | 105/377 |
| 3,526,194 | 9/1970 | Schneider et al. | 105/377 |
| 3,540,771 | 11/1970 | Stoneburner | 105/377 |
| 3,613,311 | 10/1971 | Schneider et al. | 105/377 |

*Primary Examiner*—Richard A. Bertsch

*Attorney, Agent, or Firm*—Bachman and LaPointe

[57] ABSTRACT

A superstructure for railway vehicles is disclosed having hoods which comprises at least two rails for two or more hoods positioned close to each side of a platform in a plane below the said platform, where at least one of the rails is mounted parallel and at a distance from one long side of the platform such that it can be moved back and forth on bearings.

19 Claims, 16 Drawing Figures

VEHICLE SUPERSTRUCTURE IN PARTICULAR FOR RAILWAY VEHICLES WITH HOODS WHICH CAN BE EXPANDED OUTWARDS AND MOVED WITH RESPECT TO THE LOAD BEARING PLATFORM

BACKGROUND OF THE INVENTION

The present invention relates to a vehicle superstructure, in particular a superstructure for railway vehicles with fixed end walls and a load bearing platform on which hoods can be moved on rollers, at least one of the hoods having wall and roof sections which can be moved outwards to allow the said hood to be moved along the vehicle over another hood.

The covering over the load bearing surface of such a superstructure comprises at least two hoods which are aligned with each other and are supported on rollers and, to simplify the loading or unloading the vehicle, can be pushed inside each other such that, depending on the direction of displacement of the hood, the left or the right half of the platform can be exposed completely.

Also known are hoods of different sizes, which are mounted on the load bearing surface of a vehicle and which can be pushed inside each other.

The previously mentioned superstructures with moveable hoods feature however a number of disadvantages which are related to the design and the handling of the said hoods.

It has for example been found disadvantageous with such superstructures that the surface area available for the load to be transported can not be fully utilised because of the facilities on the platform mounted parallel, side-by-side for moving and/or guiding at least two hoods. Vehicles with hoods of different sizes have shown difficulties in particular during loading and unloading, as the items being transported often lie against the inner wall of the hood and make the movement of the hoods more difficult.

The object of the present invention is to develop a vehicle superstructure with moveable hoods which is free of the disadvantages associated with the known, previously mentioned vehicle superstructures.

SUMMARY OF THE INVENTION

The foregoing object is achieved by way of the present invention wherein (a) at least two rails for two or more hoods are provided close to each of the long sides of a load bearing platform in a plane below the load bearing surface of the platform, and (b) at least one of the rails is mounted at a distance from and parallel to a long side of the platform such that it can be moved back and forwards on sliding bearings mounted to the load bearing platform.

Further advantages of the present invention will be made clear from the following detailed description.

BRIEF DESCRIPTION OF THE DRAWINGS

The drawings show in a simplified schematic form three exemplified embodiments of the present invention wherein.

DETAILED DESCRIPTION

Figure 1:
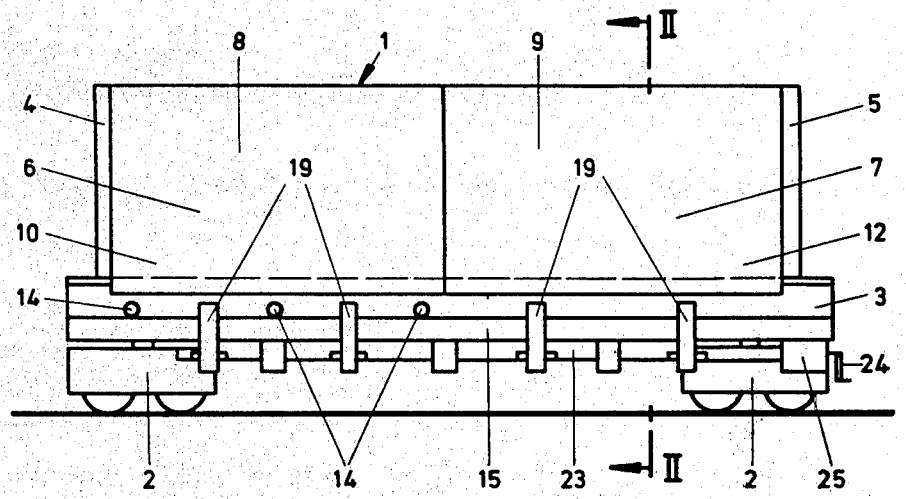
FIG. 1: Is a front view of a first exemplified embodiment of a vehicle superstructure 1 showing a superstructure 1 with two adjustable hoods 6 and 7 which can be displaced sideways and feature round roofs.
Figure 2:
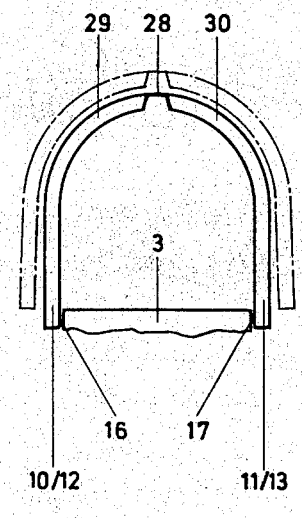
FIG. 2: Is a cross section through the vehicle superstructure 1 along the line II—II in FIG. 1, shown in full lines in the initial position, and with the sidewalls in a raised, expanded position shown in broken lines.
Figure 3:
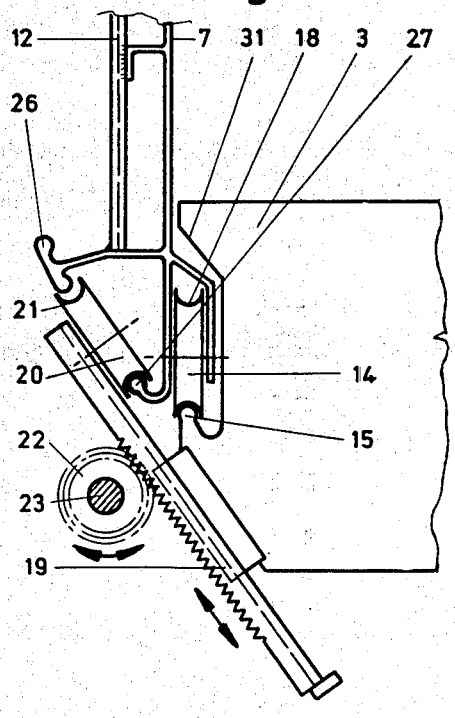
FIG. 3: Is a cross section through a part of the load-bearing platform and a part of the adjustable sidewalls of a hood, however shown here on a larger scale than in FIGS. 1 and 2.

In the first exemplified embodiment shown in FIGS. 1–3 the superstructure 1 comprises a load bearing platform which is mounted on an undercarriage and has vertical end walls 4 and 5 at each end, and two moveable hoods 6 and 7, each with round roofs 8 and 9. When the superstructure 1 is closed, both hoods 6 and 7 are in a position such as is to be seen in FIGS. 13 and 16. As FIGS. 1 and 2 show, the sidewalls 10 and 11, and 12 and 13 of the hoods 6 and 7 are then in a position where they are aligned with each other.

The rollers 14 spaced apart and mounted on the undersides of the sidewalls 10 and 11 or 12 and 13 are provided with ring-shaped grooves 18 which guide the rollers 14 on rails 15 which are provided in a recess 31 on each of the long sides 16 and 17 of the platform 3 and extend the full length of the platform 3.

Arranged on both long sides 16 and 17 of the platform 3, and spaced at equal distances along the whole length, are cogged racks 19 which are inclined and mounted such that they can move up and down. At the upper ends of the cogged racks 19 are wheels 20 which can rotate and have grooves 21 on their circumference. The cogged racks 19 assigned to hood 6 or 7 are connected to a shaft 23 which can be rotated by means of a cranking handle 24. Such a shaft 23 is provided on each of the long sides 16 and 17 of the platform 3 and assigned to a sidewall of a hood 6 or 7 so that the superstructure in accordance with the first exemplified embodiment described here has two such cogged shafts 23 for one of the two hoods 6 or 7. To be able to keep the cogged racks 19 in any desired position, a locking device 25 is provided by means of which the cogged wheels 22 or the shaft 23 can be prevented from rotating, when so desired.

On the under side of a pair of sidewalls 10 and 11 or 12 and 13 of the hoods 6 or 7 and running lengthwise are the rails 26 and 27, between which the rollers 20 run on grooves 21 on their circumference.

One of the two round roofs 8 or 9 of the hoods 6 or 7 features a strip 28 of flexible material which runs lengthwise in the middle of the roof about which the two rigid halves 29 and 30 of the hood separated by the strip 28 can be tilted within a predetermined range.

The superstructure 40 shown in FIGS. 4–10 is a second exemplified embodiment of the invention comprising a load-bearing platform 42 on an undercarriage 41, vertical end walls 43 and 44 and two moveable hoods 45 and 46 with roofs 47 and 48 respectively.

Figure 4:
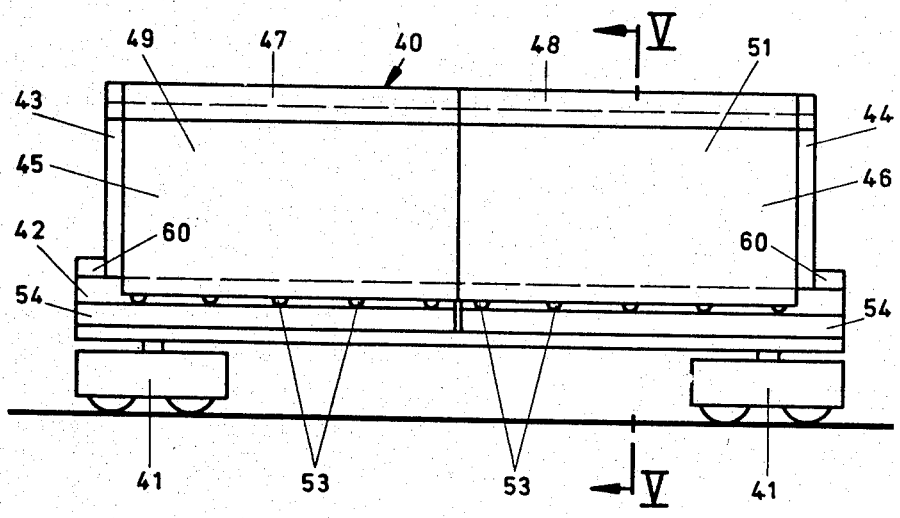
FIG. 4: Is a front view of a second exemplified embodiment of an enclosed vehicle superstructure 40 with hoods 45 or 46, each of which can be moved on rollers at the long side of the platform, and featuring two straight walls or parts of walls which can be displaced on a horizontal plane and a flat roof which can be raised and lowered.
Figure 5:
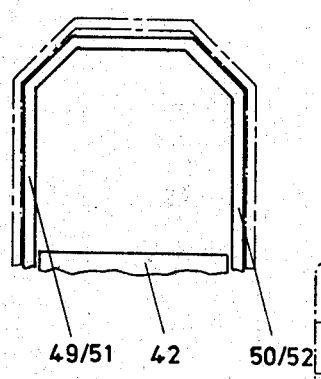
FIG. 5: Is a cross section through the vehicle superstructure 40 along the line V—V in FIG. 4, shown here in full lines in the initial position, and with the sidewalls in an expanded position in broken lines.
Figure 6:
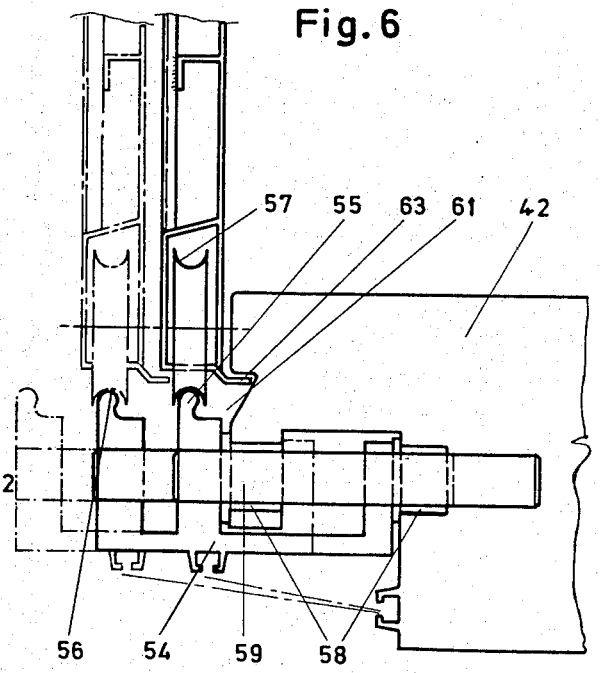
FIG. 6: Is a cross section through a part of the platform and part of the adjustable sidewall of a hood, shown here on a larger scale than in FIGS. 4 and 5.
Figure 13:
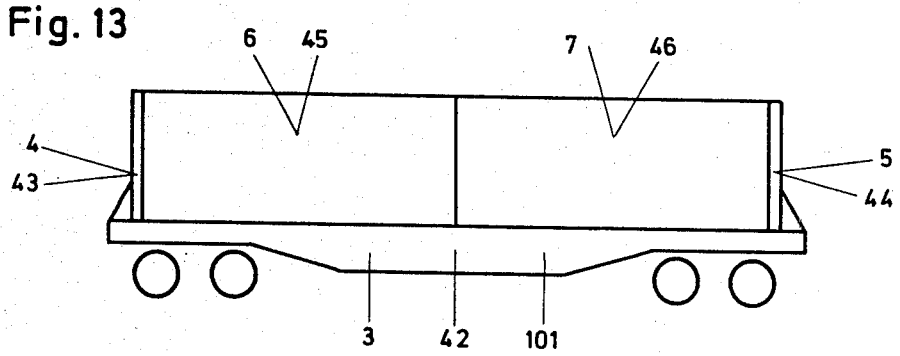
FIG. 13: Is a schematic front view of a closed vehicle superstructure corresponding to the third exemplified embodiment, whereby the sidewalls of both hoods are in line with each other.
Figure 16:
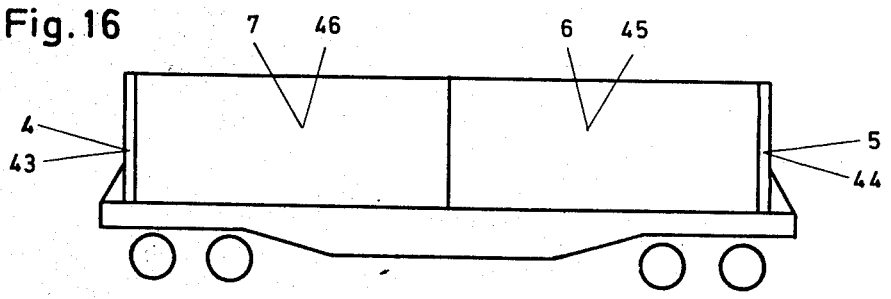
FIG. 16: Is again a vehicle superstructure closed over by both hoods, but with the hoods having changed places.

When the superstructure is closed, the hoods 45 and 46 are in a position as shown for example in FIGS. 4, 13 and 16. In this position the sidewalls 49 and 50 and 51 and 52 of the hoods 45 and 46 respectively are aligned with each other and are supported on rollers 53 on pairs of rails 54 which are mounted below the load bearing surface of the platform 42 and can be moved on a horizontal plane backwards and forwards perpendicular to the longitudinal axis of the vehicle. Each of the rails 54 feature two flanges 55 and 56 which run approximately the length of a sidewall 49, 50, 51 and 52, so that the superstructure 40 has at least four double rails 54 which can be moved independently of each other. The rollers 53 feature grooves 57 to guide them along rails 55 and 56.

The bearings 58 for the arm 59 supporting the double rail 54 are provided under the load bearing surface close to the long edges of the platform 42. The arms 59 are permanently attached to the double rails 54, spaced apart at regular distances. The double rails 54 can in turn be moved back and forwards on a plane perpendicular to the long axis of the platform 42 on bearings 58 on the underside of the platform 42. A generally known device 60 for effecting movement is connected to the supporting arms 59 of each of the double rails 54 to move these rails in the desired manner.

On both sides of the platform 42 and extending the full length of the platform 42 is a recess 61 into which project safety flanges 63 which are attached to each of the sidewalls 49, 50, 51 and 52.

Figure 7:
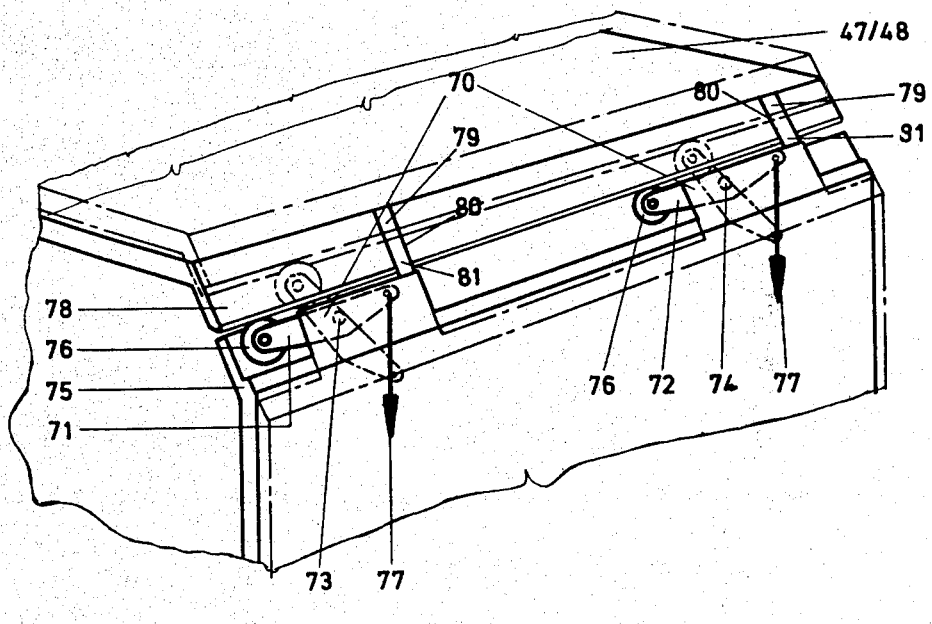
FIG. 7: Is a perspective view of a hood in keeping with the second exemplified embodiment, fitted with a raising and lowering facility which has a two-armed lever for the flat roof, which is in a raised position, and for the expanded sidewalls of the hood.

The raising and lowering device 70 for the flat roof 47 or 48 shown in FIG. 7 comprises two two-armed levers 71 and 72 which pivot about hinges 73 and 74 respectively. The hinges are in turn mounted on an upper, flat end piece 75 of a sidewall 49, 50, 51 or 52 and preferably inclined at an angle of 30°–60°. The two-armed levers 71 and 72 on the inside of the end piece 75 i.e. in the interior of the superstructure 40 feature on one end a roller 76 and on the other end a hinged rod 77 for applying pressure or tension.

The roofs 47 and 48 feature on their ends facing the sidewalls 49–52—in the same way as the sidewalls—preferably inclined at an angle of 30°–60°, flat end pieces 78 which are aligned with the end pieces 75 of the sidewalls, but from which they can be raised.

To keep the end pieces 78 of the roofs aligned with the end pieces 75 of the sidewalls, aligning facilities 79 in the form of grooves 80 in the end piece 78 of a roof and correspondingly shape projections or rails 81 on the end piece of a sidewall are provided.

Figure 8:
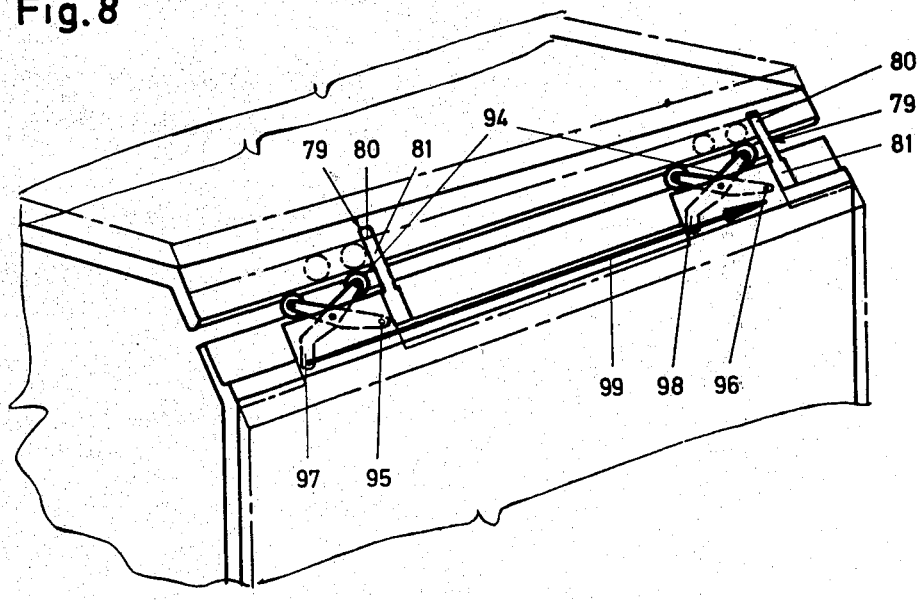
FIG. 8: Is a raising and lowering device, which has the form of shears, for the flat roof shown here in a perspective view in a partly raised or expanded position.

The raising and lowering facility 94 for the roof, illustrated in FIG. 8, features, in comparison with that facility 70 in FIG. 7, on both sides of the hoods two pairs of shears 97 and 98 which pivot about stationary points 95 and 96 and are connected via a rod 99 which effects the raising and lowering of the roof. The alignment facility, by means of which the end pieces 78 of the roofs are kept in line with the end pieces 75 of the sidewalls, is of the same form as the previously described facility 79, 80 and 81 in FIG. 7.

Figure 9:
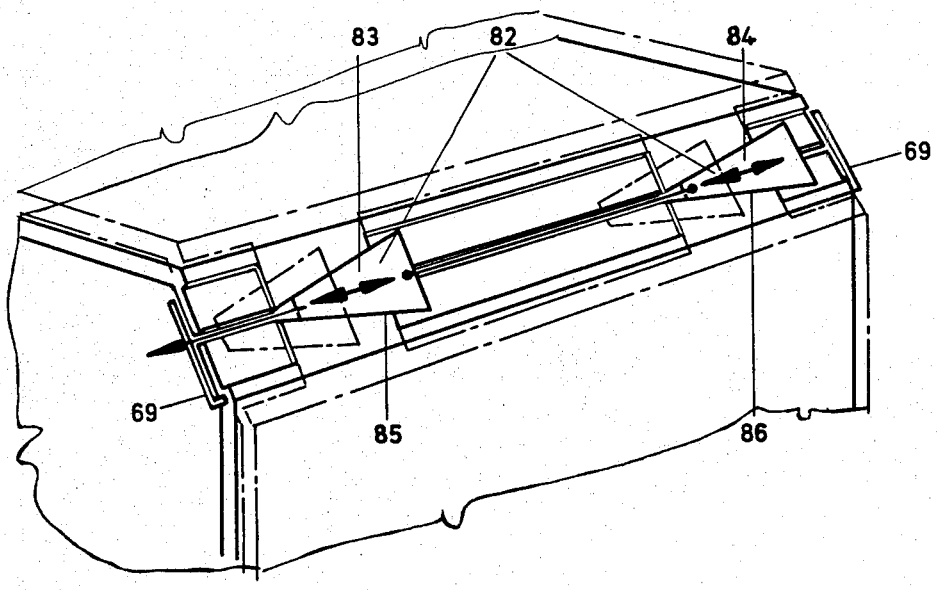
FIG. 9: Is a perspective view of a device which features a moveable wedge for raising and lowering the flat roof of a hood, corresponding to the second exemplified embodiment, shows here in the lowered position.

The facility 82 for raising and lowering the roof shown in FIG. 9 comprises wedges 83 and 84 which are moved back and forward horizontally to act on the appropriately inclined faces 85 and 86 on the end pieces of the sidewalls and on both end pieces of the roof. The said wedges 83 and 84 are joined by a rod arrangement to set them in operation. The stop 69 is fitted to the end piece 75 of the sidewall which is in line with the end pieces 78 of the roofs.

Figure 10:
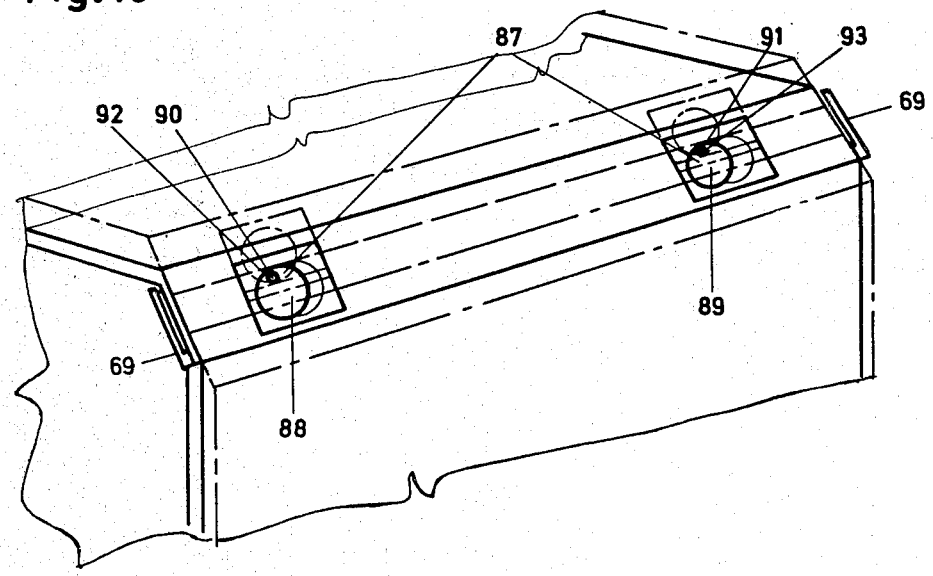
FIG. 10: Is a perspective view of a device which features a cam-like facility for raising and lowering the flat roof of a hood corresponding to the second exemplified embodiment, shown here in a lowered position.

The device 87 which is shown in FIG. 10 and is for raising and lowering the roof comprises round discs 88 and 89 which are fitted to the end piece of the sidewall such that they pivot about off-centre pins 90 and 91 respectively, which engage with holes 92 and 93 in the end parts of the roof. The discs 88 and 89 are connected by a rod arrangement by means of which the device 87 is made to operate. The stop 69 is fitted to the end piece 75 of the sidewall which is in line with the end piece 78 of the roofs.

Figure 11:
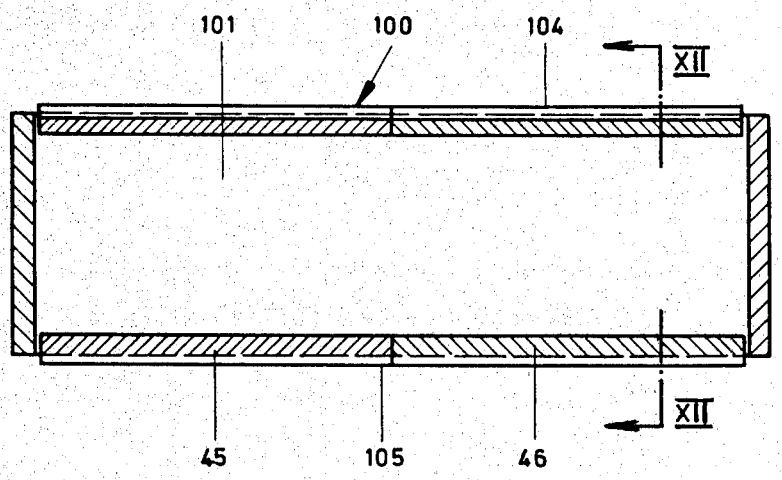
FIG. 11: Is a plan view of a load bearing platform 101 of a vehicle superstructure 100 corresponding to a third exemplified embodiment.
Figure 12:
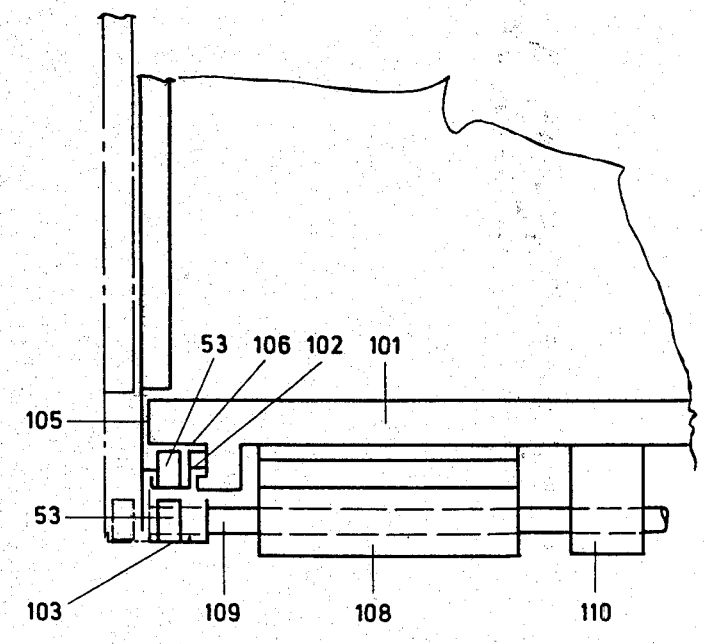
FIG. 12: Is a section through the platform shown in FIG. 11 along the line XII—XII in that figure, but on a larger scale.

The third exemplified embodiment of a vehicle superstructure 100 shown in FIGS. 11 and 12 features, as FIG. 11 shows, a platform 101 on both sides of which and preferably below the load bearing surface there is a fixed, immoveable rail 103 on which the sidewalls of the hoods 45 and 46 can be moved.

Provided on both of the long sides 104 and 105 of the platform 101 and extending the full length of the platform are recesses 106 in each of which a rail 102 for the sidewalls of the hoods 45 and 46 is permanently attached to the platform 101.

Under the platform 101 and at predetermined uniform spacing over the whole length are bearings 108 which support arms 109 which are permanently attached to the second, moveable rail 103. The second rail 103 is mounted parallel to the first rail 102 and likewise extends the whole length of the platform 101. The supports 109 for the rails 103 are mounted in the bearings 108 in a horizontal plane perpendicular to the long axis of the platform 101 such that they can slide back and forward in response to a facility 110 to which they are connected.

The provision of the stationary and moveable rails 102 and 103 on each side of the platform 101 allows—like the arrangement and shape of the rails 55 and 56 in the second exemplified embodiment of the invention—the hoods 45 and 46 to be moved as described below, as the sidewalls of one hood are supported on rollers on the fixed rail 102 and the sidewalls of the other hood on rollers on the moveable rail 103.

It is also possible—in a way not shown here—to provide a connecting drive between the facilities 70, 82, 87 and 94 for raising and lowering the roofs and the devices 24 or 60 and 110 for moving out the sidewalls of a hood, if this is desired, so that the sidewalls can be moved out and the roof of a hood can be raised by one single drive mechanism.

Figure 14:
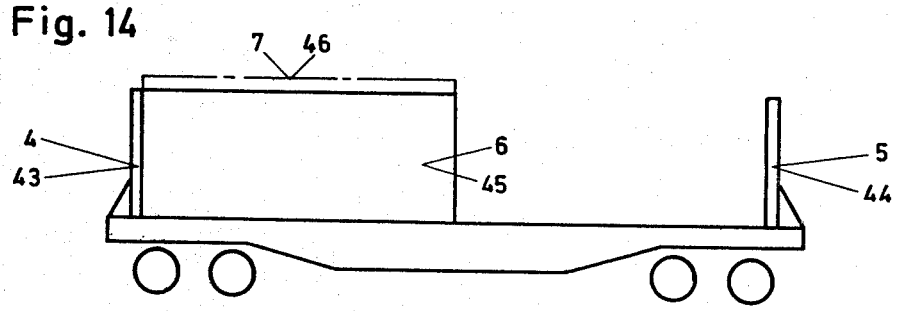
FIG. 14: Is the same vehicle as in FIG. 13 with the right half of the load bearing platform exposed and the right hood having been pushed over the left hood.

The hoods on the vehicle are moved as follows to allow loading and unloading:

In the case of the first exemplified embodiment shown in FIGS. 1–3 and the loading or unloading sequence in FIGS. 13–16, starting from the closed vehicle in FIG. 13, the right half of the platform 3 is exposed first, as shown in FIG. 14. This is accomplished first by unlocking the hood 7 i.e. freeing it from the end wall 5; the cogged racks 19 for moving the sidewalls 12 and 13 of hood 7 are moved out and upwards by the cogged shaft 23 using the cranking handle 24 for each cogged shaft. As a result, at the same time the sidewalls of hood 7 with which the rails 26 and 27 form a unit move outwards and upwards.

Figure 15:
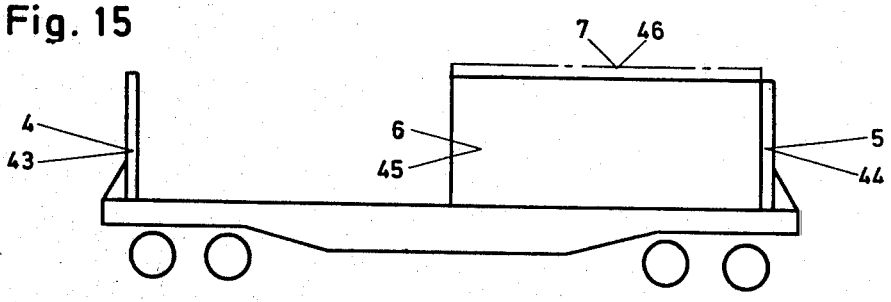
FIG. 15: Is the same vehicle as in FIGS. 13 and 14 with the left half exposed and both hoods pushed together over to the right hand side.

The hood 7 which is then in the raised position is pushed over hood 6, thus exposing the right half of the load bearing surface of the platform 3 completely so that this area, as shown in FIG. 14, can be loaded or unloaded. In this position hood 7 is locked to hood 6. After this, to expose the left hand side of the platform 3, as shown in FIG. 15, the hood 6 is first released from the end wall 4 and then both hoods 6 and 7 pushed together up to the end wall 5. The hood 6 is then locked to the end wall 5.

After loading or unloading, the vehicle is closed again. To do this the raised hood 7 is first unlocked from hood 6, pushed up to the end wall 4 and then lowered by lowering and drawing in the sidewalls by means of the cogged racks 19 via the cogged shaft 23 and the handle 24. After the hood 7 has been lowered, it is again locked on to the end wall 4.

In the case of the second exemplified embodiment of the invention shown in FIGS. 4–10 and the loading or unloading sequence in FIGS. 13–16, starting from the closed vehicle shown in FIG. 13, the sideways movement of the hoods for loading or unloading is carried out in the same way as in the first example described above.

Differing from this is, instead of the raising and simultaneous opening out of the sides of one of the hoods 6 or 7 in the first example, the raising of the roof 47 or 48 of one of the two hoods 45 or 46 and the simultaneous sideways movement of a pair of sidewalls of either of the hoods by means of a device 60 with which the double rail 54 for sidewalls 49 and 50 or 51 and 52 can be moved outwards sideways or towards the middle of the waggon.

For example, to expose the right hand side of the platform 42, as shown in FIG. 14, the hood 46 is first made free i.e. unlocked from end wall 44. Next, the roof 48 is raised and the sidewalls 51 and 52 of hood 46 moved by means of a device 60 which moves the double rails 54 outwards into a predetermined position such as shown in broken lines in FIG. 6.

With the roof and sidewalls in the described position the hood 46 is then pushed over hood 45 thus exposing the whole of the right half of the platform 42. The displacement of hood 46 with respect to hood 45 is possible because, on moving the sidewalls 51 and 52 of hood 46 outwards, the outer rail 56 of the double rail 54 for hood 45 is aligned with the inner rail 55 of the double rail 54 for hood 46, so that on sliding the hood 46 with respect to hood 45, the rollers 53 of hood 46 run on the outer rail 56 i.e. past roller 53 of hood 45 which are in the inner rail 55 of a double rail 54.

After hood 46 has been pushed over hood 45, both hoods 45 and 46 are locked to the end wall 43 and the double rails 54 for the second hood returned to their original position.

Later, to expose also the left half of the platform 42, as shown in FIG. 15, hood 45 is first released from the end wall. Then both hoods 45 and 46 are pushed together over to the end wall 44 or the right side of the platform 42 and locked to that wall 44.

After loading or unloading the left hand side of the platform 101, the superstructure 100 is closed again by unlocking the hood 46 with the raised roof 48 from hood 45 and end wall 44 and sliding it along to the end wall 43. With the hood 45 in this position the flat roof 48 and the sidewalls 51 and 52 of hood 45 are returned to the original position i.e. by moving the rails 103 towards the middle of the platform 101 and then locking hood 46 to the left end wall 43.

As shown in FIGS. 1–3 and 4–10, both hoods (6,45 and 7,46) can also be made such that they can be opened out, so that to expose one half of the vehicle the hood covering that half can be opened out and moved and after closing the first hood the second hood can be opened up in a similar manner.

The invention is not limited to the exemplified embodiments or designs shown here, other designs of superstructure are also possible and within the scope of the invention without diverging from the principle of the invention itself.

Usefully, the invention makes it possible to manufacture, in a relatively simple manner, a vehicle superstructure which ensures optimum possibilities for loading and unloading at the same time making full use of the load carrying space.

What is claimed is:

1. A railway car comprising a railway undercarriage, a load bearing platform mounted on said undercarriage, first and second end walls mounted on the ends of said load bearing platform, at least one rail provided on either end of said load bearing platform and extending substantially the entire length of said load bearing platform from said first end wall to said second end wall, at least two hoods movably mounted with respect to said first and second end walls on said load bearing platform, said at least two hoods having side walls and a roof, said side wall of said at least two hoods being provided with roller means on said side walls adapted to rollingly mate with said at least one rail provided on either side of said load bearing platform and displacement means provided on said load bearing platform for selectively displacing outwardly said side walls of at least one of said at least two hoods away from said load bearing platform so as to enable said at least one hood having said displaced side walls to slide over the other of said at least two hoods.

2. A railway car according to claim 1 wherein said displacement means comprises a plurality of cogged racks mounted on either side of said load bearing platform and a rotatable cogged shaft on either side of said load bearing platform engaging said plurality of cogged racks for reciprocating said cogged racks between a first position wherein said side walls are not displaced to a second position wherein said side walls are displaced upon rotation of said cogged shaft.

3. A railway car according to claim 2 wherein said plurality of cogged shafts are provided with roller means rotatably mounted thereon, said roller means being provided with a continuous groove around the periphery thereof.

4. A railway car according to claim 3 wherein said side wall is provided with first and second rails which are adapted to be selectively received in said groove provided on said roller means.

5. A railway car according to claim 4 wherein said first rail is received in said groove when said side walls are not displaced.

6. A railway car according to claim 4 wherein said second rail is received in said groove when said side walls are displaced.

7. A railway car according to claim 2 wherein said plurality of cogged racks are mounted on said load bearing platform at an angle with respect to said side walls of said at least two hoods such that movement of said cogged racks from said first position to said second position simultaneously displaces said side walls away from said load bearing platform while at the same time elevating said hood with respect to said load bearing platform.

8. A railway car according to claim 1 wherein said at least one rail provided on either side of said load bearing platform comprises an integral portion of said load bearing platform.

9. A railway car according to claim 1 wherein said roof of said at least two hoods comprises in part a strip of pliable material running the length of said roofs whereby said side walls bend about said strip when displaced by said displacement means.

10. A railway car according to claim 1 wherein said displacement means comprises a plurality of support arms slidably received in bearings provided on either side of said load bearing platform.

11. A railway car according to claim 10 further including means associated with said plurality of support arms for reciprocating said support arms between a first position wherein said side walls are not displaced to a second position wherein said side walls are displaced.

12. A railway car according to claim 11 wherein two rails are provided on either side of said load bearing platform.

13. A railway car according to claim 12 wherein said two rails are fixedly mounted on said plurality of said support arms for movement therewith.

14. A railway car according to claim 12 wherein one of said two rails comprises an integral portion of said load bearing platform and the other of said two rails is fixedly mounted on said plurality of said support arms for movement therewith.

15. A railway car according to claim 11 further including means associated with said roof and said side walls for raising and lowering said roof with respect to said side walls and said load bearing platform.

16. A railway car according to claim 15 wherein said means for raising and lowering said roof comprises at least one lever pivotably mounted on each of said walls in abutting relationship with said roof.

17. A railway car according to claim 15 wherein said means for raising and lowering said roof comprises a pair of wedges movably mounted at the interface of said side walls and said roof.

18. A railway car according to claim 15 wherein said means for raising and lowering said roof comprises at least one disc offsetly mounted on each of said side walls in abutting relationship with said roof.

19. A railway car according to claim 15 wherein said means for raising and lowering are connected to said displacement means.

* * * * *